US006366238B1

(12) United States Patent
DeMore et al.

(10) Patent No.: US 6,366,238 B1
(45) Date of Patent: Apr. 2, 2002

(54) PHASED ARRAY BEAMFORMER MODULE DRIVING TWO ELEMENTS

(75) Inventors: Walter R. DeMore, La Crescenta; Bruce A. Holmes, Redondo Beach; Martin Nunez, Carson, all of CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/790,245

(22) Filed: Feb. 20, 2001

(51) Int. Cl.[7] ..... H01Q 3/22

(52) U.S. Cl. ..... 342/368

(58) Field of Search ..... 342/368, 373

(56) References Cited

U.S. PATENT DOCUMENTS 6,246,364 B1 * 6/2001 Rao et al. ..... 342/368

* cited by examiner

*Primary Examiner*—Thomas H. Tarcza
*Assistant Examiner*—Fred H. Mull
(74) *Attorney, Agent, or Firm*—DiPinto & Shimokaji, P.C.

(57) ABSTRACT

A modular beamformer system for providing signals to at least two radiating elements of a phased array antenna is provided. The system includes a right-hand circular polarization beamformer module and a left-hand circular polarization beamformer module. The left and right circular polarization beamformer modules are coupled to two radiating elements. Each beamformer module includes two groups of beamforming circuitry, one per radiating element. At least one feeder line extends from each beamforming circuitry and is coupled to one of the radiating elements to transmit an output of each beamforming circuitry.

17 Claims, 8 Drawing Sheets

FIG. 1B
PRIOR ART
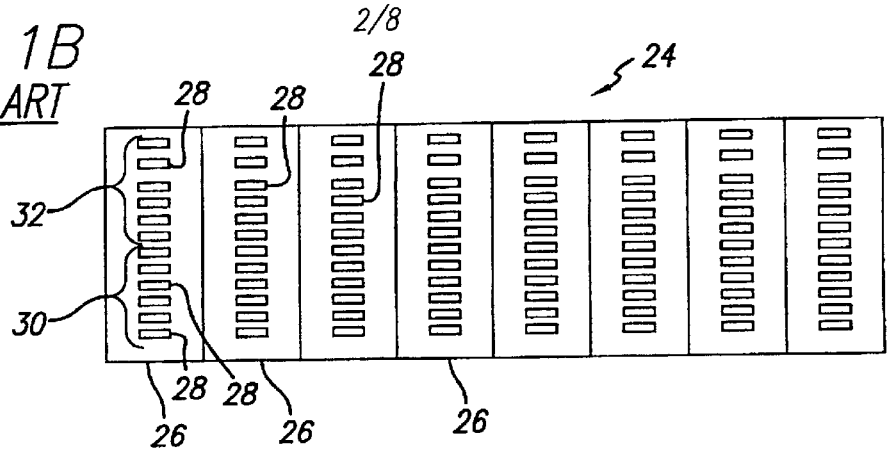
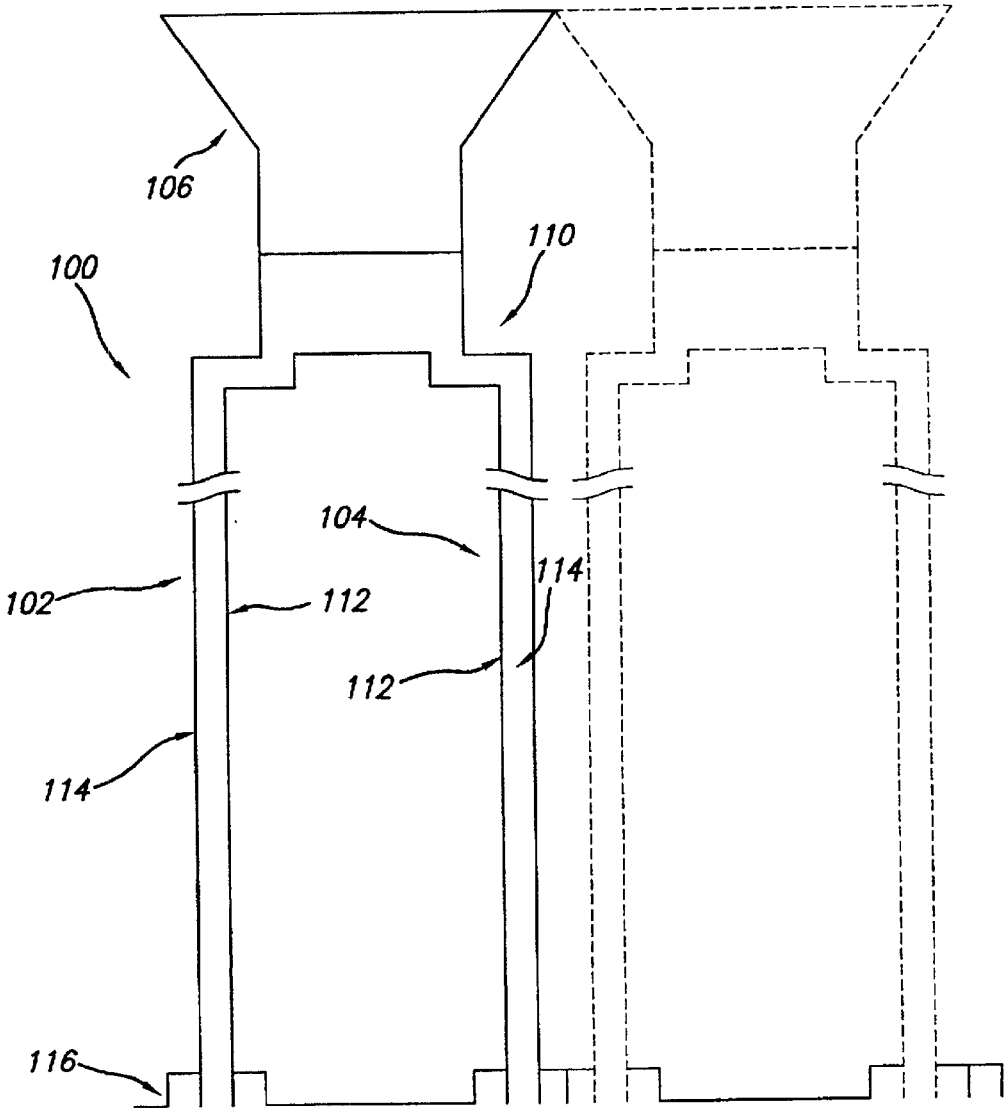
FIG. 2A

PHASED ARRAY BEAMFORMER MODULE DRIVING TWO ELEMENTS

BACKGROUND OF THE INVENTION

1. Field of the Invention

The present invention generally relates to antennas and, more particularly, to phased array antennas.

2. Description of the Related Art

Recent advancements in satellite communications technologies have placed increasing system performance requirements on the antenna systems. This is particularly true for the phased array antenna systems.

Phased array antennas are generally composed of an array of radiating elements coupled to a signal input source through a number of identical beamformer modules. The beamformer modules are connected to the antenna main signal source and to the antenna frame through a wave guide interface surface so as to form a parallel stack of beamformer modules on the wave guide interface surface. A certain number of modules are arranged in equidistant parallel stacks which are perpendicularly connected to each wave guide interface surface. By convention, each radiating element is connected to a top end of each beamformer module and thereby form a subarray of radiating elements.

In the foregoing configuration, when the subarrays are placed in a side-by-side fashion, the array of radiating elements forms the top end of the antenna. The radiating elements individually or in the form of subarrays provide a directed beam of electromagnetic signals such as radio frequency (RF) signals. Each module contains phase shifter circuitry having phase shifter elements to control the phase of the inputted signals. By shifting the phase of the inputted signals in each phase shift element, the direction of the antenna beam can be changed without needing to mechanically move the antenna. The number of phase shifter elements per array module determines the number of beams that an antenna can generate and thus the RF throughput of the antenna.

Due to the strict design constraints on the dimensions of the radiating elements and the modules of an antenna, it is necessary to match the planar area occupied by the upper edge of a subbarray of radiating elements with the area of a wave guide interface surface. In other words, the projection of the planar area occupied by the radiating elements onto the interface surface defines the area that a module of the radiating element is permitted to occupy. Since the radiating elements follow strict dimensional limitations, this situation limits the size of the beamformer modules and hence the number of phase shifter elements per module, which in turn limits the number of beams that can be generated using a single module.

One prior art solution to this problem may be demonstrated with FIGS. 1A and 1B which illustrate two prior art beamformer modules 10 and 12, each having six phase shifters 14. The phase shifters 14 are connected to signal source input lines 16 extending between input connectors 17 and the phase shifters 14. The output wiring 18 from the phase shifters 14 is connected to radiating elements 20 and 22 which are coupled to top ends of the modules 10 and 12 respectively. In a side-by-side configuration shown in FIG. 1A, the modules 10 and 12 with the radiating elements 20 and 22 are placed on top of a wave guide interface surface 24 shown in FIG. 1B. The interface surface 24 has eight rows 26 having twelve input connection slots 28 to receive input connectors 17 of the modules 10, 12. In this configuration, a first group 30 of slots 28 receives the module 10 and the second group 32 of slots 28 receives the module 12. The other slots 28 are filled in with a similar side-by-side placement method. However, due to the design constraints, the above mentioned disadvantages still remain with this prior art method, which can only provide a limited six beam input per beamformer module and 12 beam inputs per row on the interface surface 24.

As can be seen, there is a need for the formation of alternative beamformer configurations in phased array antenna systems that increases the number of beams and the RF efficiency of the antenna.

SUMMARY OF THE INVENTION

In one aspect of the present invention, a modular beamformer system for providing signals to at least two radiating elements of a phased array antenna comprises a first beamformer module and a second beamformer module. The first beamformer module is coupled to at least two radiating elements. The first beam former module comprises at least two groups of beamforming circuitry on a primary plane of the first beamformer module and at least one feeder line extending from each beamforming circuit. Each feeder line is coupled to one of the radiating elements to transmit an output of each beam forming circuit. The second beamformer module is also coupled to at least two radiating elements. The second beam former module comprises at least two groups of beamforming circuitry on a primary plane of the second beamformer module and at least one feeder line extending from each beamforming circuitry. Each feeder line is coupled to one of the radiating elements to transmit an output of each beam forming circuitry.

These and other features, aspects and advantages of the present invention will become better understood with reference to the following drawings, description and claims.

BRIEF DESCRIPTION OF THE DRAWINGS

FIG. 1B is a schematic view of the wave guide interface of the prior art;

FIG. 2A is a schematic side view of the dual beamformer system of the present invention;

DETAILED DESCRIPTION OF THE INVENTION

Figure 1A:
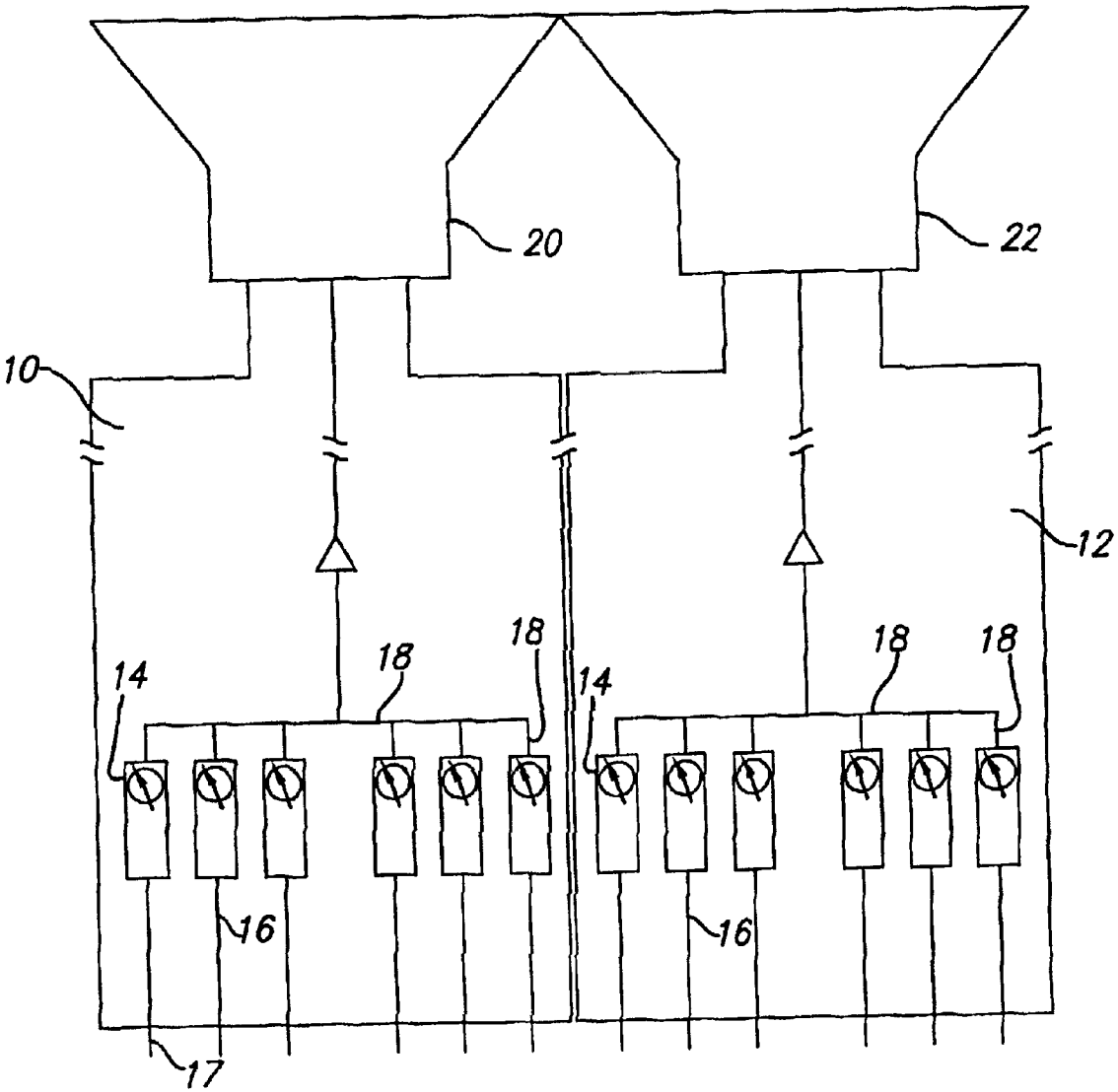
FIG. 1A PRIOR ART
FIG. 1A is a schematic view of beamformer modules of the prior art.

The dual module system of the present invention increases the number of beams generated from a phased array antenna device. With the invention, the beams to be implemented are increased in the dual module system and the corresponding radiating element array row. This system doubles the number of beams in comparison to the above given prior art system. As in the aforementioned prior art, the planar surface area occupied by the array elements and the area of the wave guide interface surface are generally in a one-to-one dimensional agreement. In the above prior art, the modules of an array row of two radiating elements can only be coupled onto a designated row area on the interface surface of a wave guide power splitter which is connected to the antenna input sources. As also mentioned in the above prior art, a typical phased array antenna features one beamformer module per radiating element, and the design constraints for the radiating elements places the modules in a side-by-side configuration on a designated section of the wave guide interface surface. For example, a typical radiating element covers a 2"×2" square area, and two radiating elements cover a 2"×4" rectangular area. On the interface surface, the designated area required for the modules of the radiating elements is limited to an area of 2"×4". This conventional approach limits the size of the modules and the amount of circuitry they can have. This, in turn, restricts the number of RF beams that can be generated in a single radiating element to less than half the number that can be implemented using the present invention.

In accordance with the principles of the present invention, the dual module system of the present invention comprises two beamformer modules that are a right hand circular polarization beamformer and a left hand circular polarization beamformer. The left and right hand beamformers are mounted onto a single row on the interface surface and adjacent to each other. Both beamformers drive two beam-radiating elements in an array of a plurality of beam radiating elements. In a preferred embodiment, each beamformer module is equipped with twenty-four channels of MMIC (monolithic microwave integrated circuit) amplitude and phase weighting circuits driving two array element SSPAs (solid state power amplifier). Again, in each beamformer of the system, the twenty-four channels are arranged in two groups of twelve, one group for each array element or radiating element.

Each of twelve module beam inputs is split into two, one for each array element resulting in a total of twelve beam inputs as opposed to the prior art six beam inputs to a singe radiating element. Advantageously, both beamformers share the same space designated for two radiating elements in two array rows. The dual module system doubles the number of beams fed to each radiating element in a phased array antenna system. Also, the width of the modules may be increased, allowing the beamformer implementation to move from a high loss but more compact implementation such as strip-line to a larger but lower loss implementation such as a wave guide. This reduces the RF losses of the beamformer circuitry. In this implementation, the insertion loss of the RF beamforming network is reduced by 4 to 6 dB, allowing a reduction in input RF drive power to 25–40% of that required for the prior state of the art.

Reference will now be made to the drawings wherein like numerals refer to like parts throughout. FIGS. 2A–2E show the dual module system 100, or dual element beamformer module, of the present invention. The dual module system 100 comprises a first beamformer module 102 (FIG. 2B) and a second beamformer module 104 (FIG. 2C) which is interlaced with the first module 102. As will be described below, each module generally has the same size, shape, and circuitry as the other. The difference is that the circular polarization of the circuitry on the first module 102 is opposite to the circular polarization of the circuitry of the second module 104.

Figure 2B:
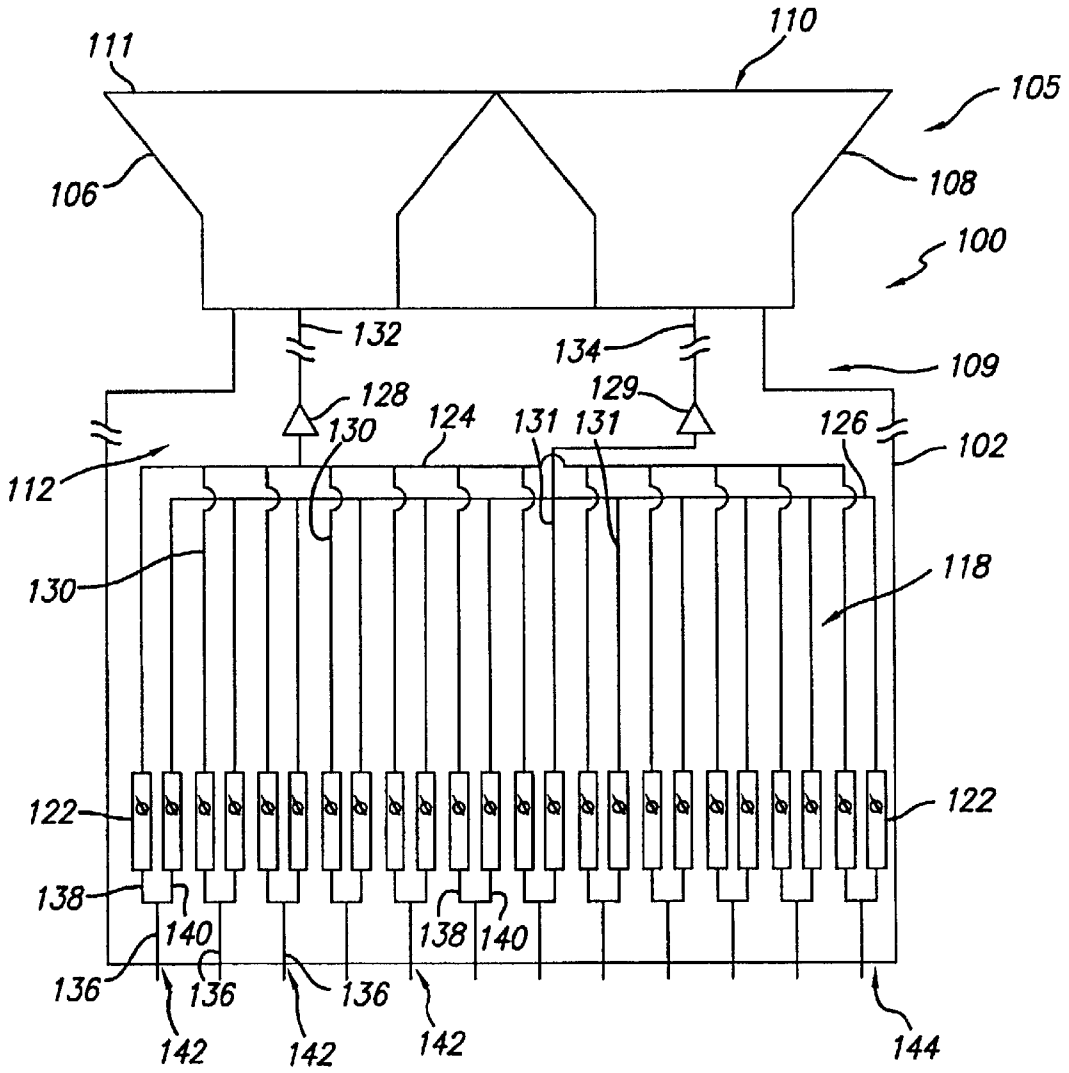
FIG. 2B is a schematic view of an RF side of a first beamformer module of the dual beamformer system with dual radiating elements.
Figure 2C:
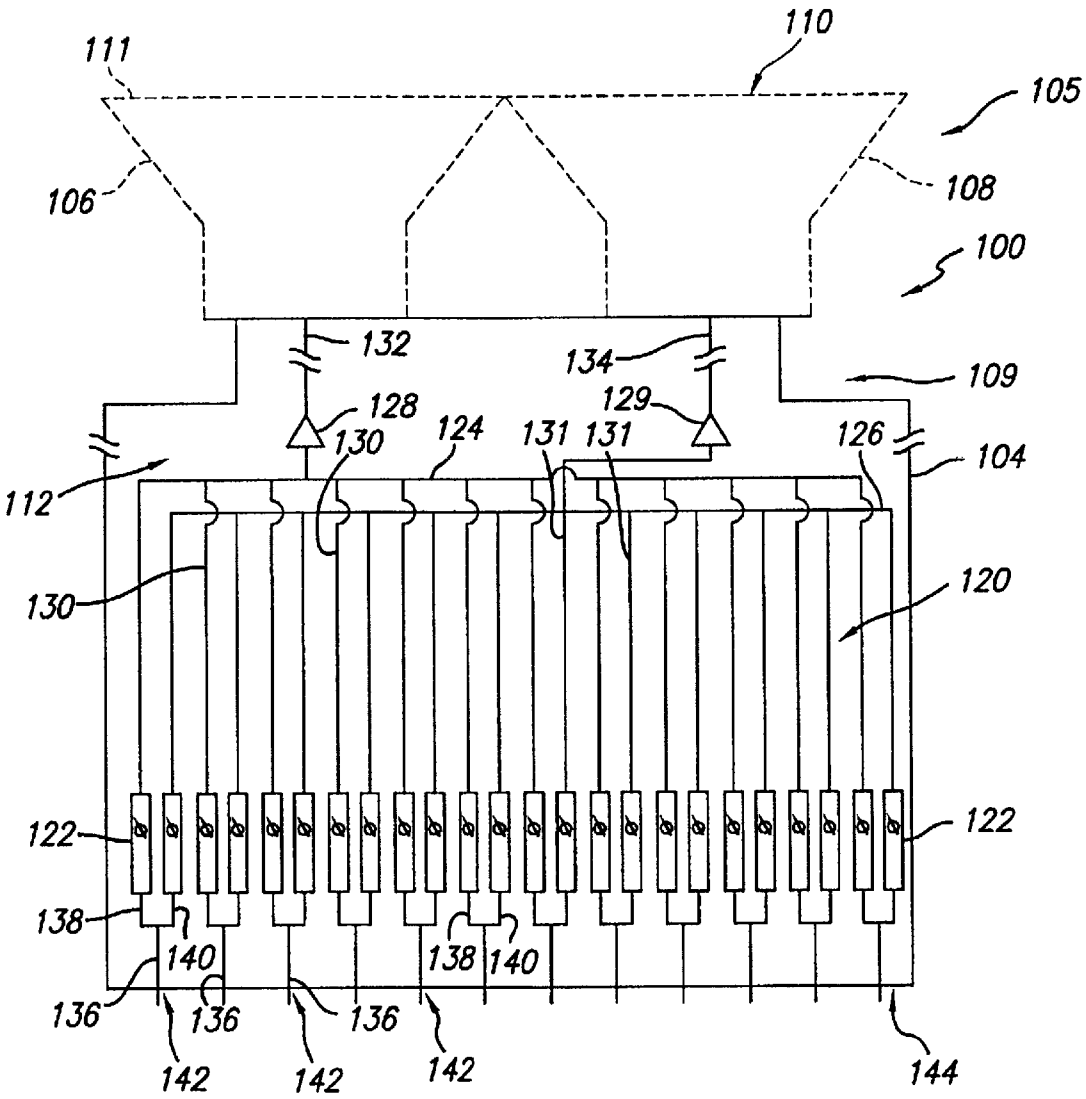
FIG. 2C is a schematic front view of an RF side of a second beamformer module of the dual beamformer system.
Figure 2D:
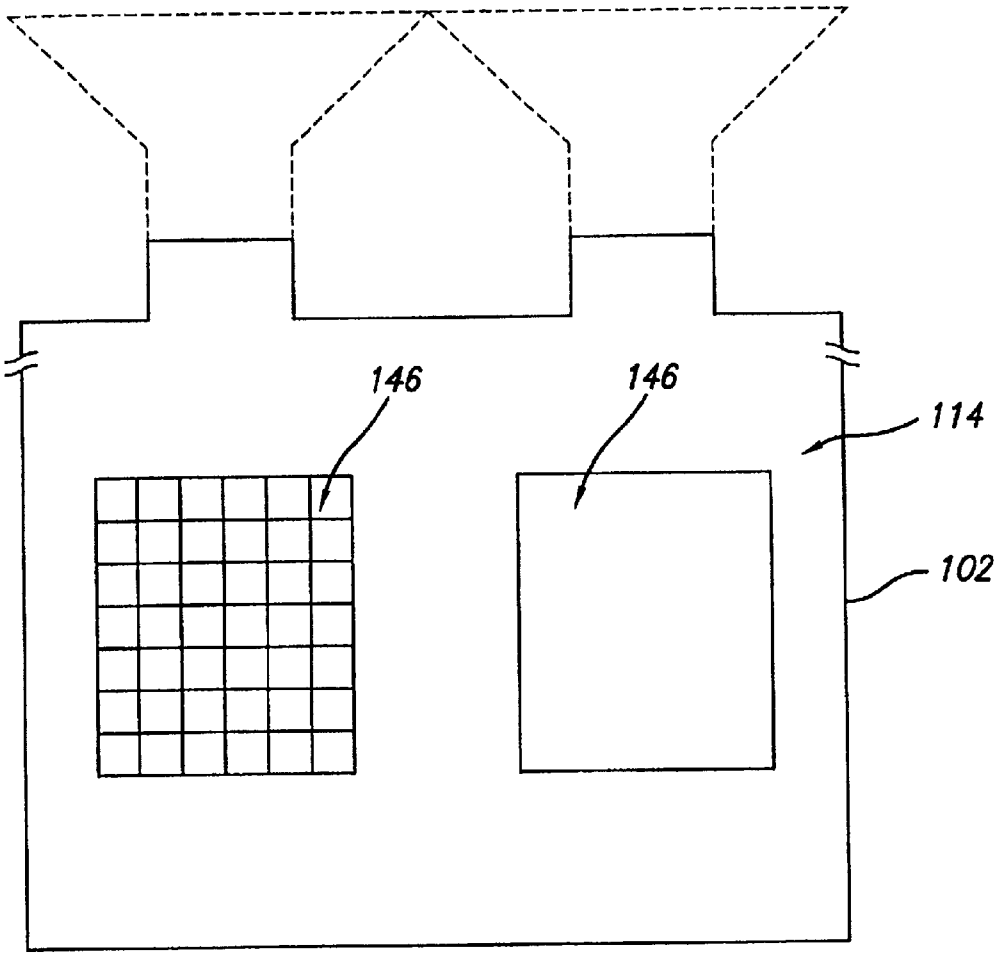
FIG. 2D is a schematic view of a DC side of the first beamformer module of the dual beamformer system.
Figure 3A:
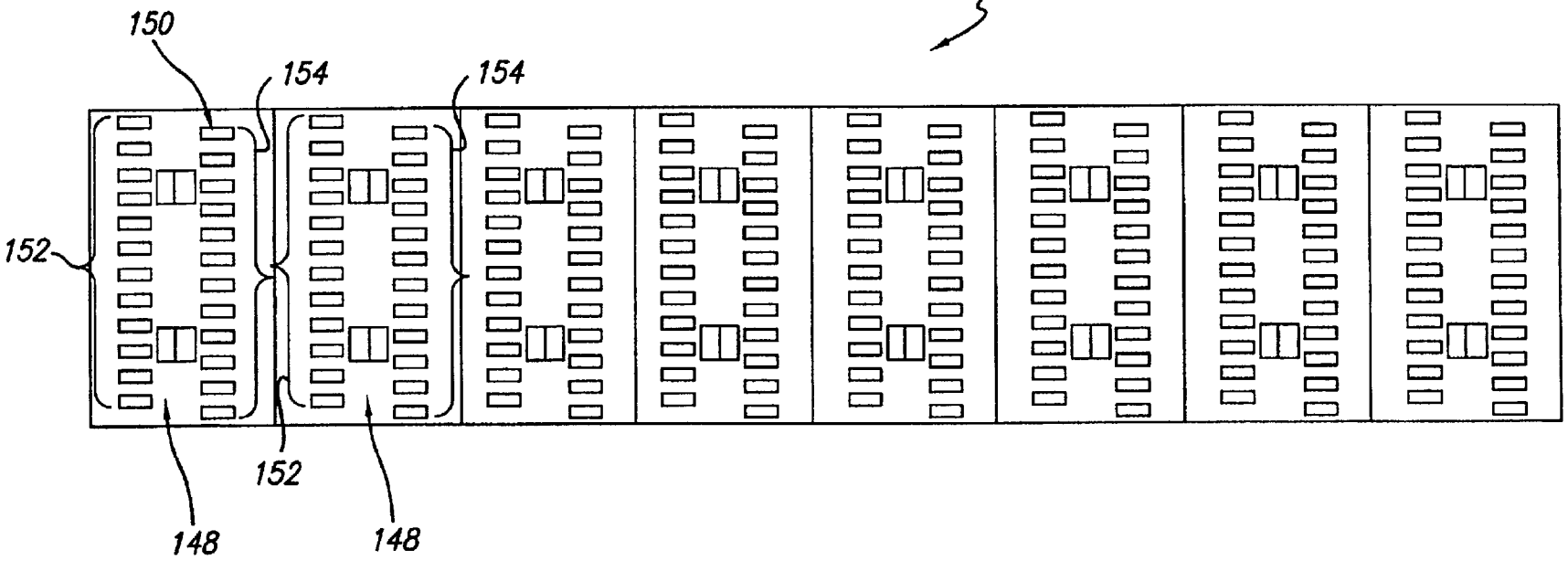
FIG. 3A is a schematic view of an interface of a wave guide power splitter device of the present invention.
Figure 3B:
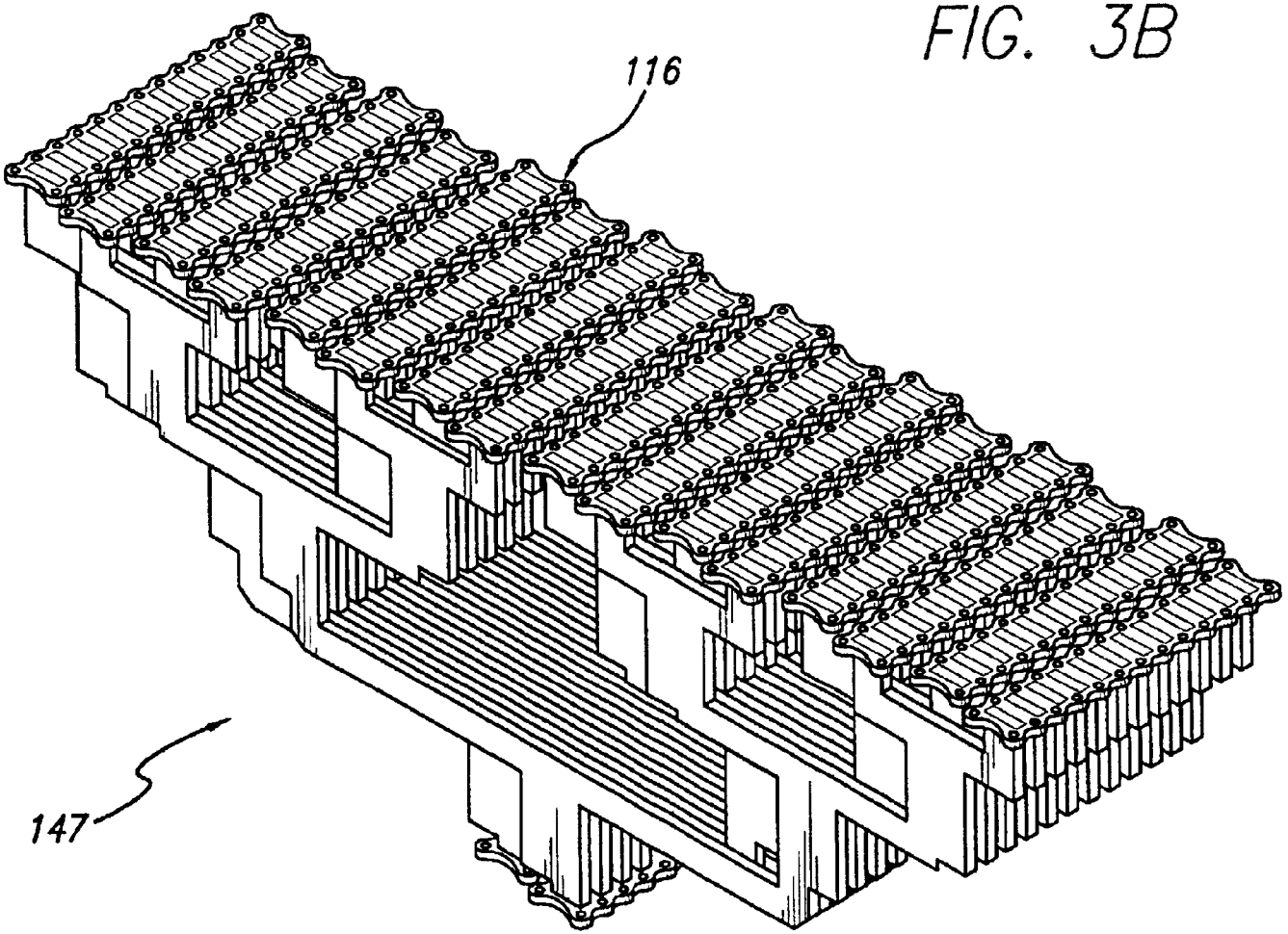
FIG. 3B is a schematic perspective view of the wave guide power splitter device of the present invention.

In FIGS. 2B–2C, a dual radiating element 105 comprises first and second radiating elements 106 and 108 which are secured on an upper or first portion 109 of the system 100 and electrically connected to the modules 102 and 104. The dual radial element 105 defines a top planar area 110 that is the planar area defined by the top peripheral edge 111 of the dual element 105. The modules 102 and 104 further comprise a primary surface 112 or RF (radio frequency) side and a secondary surface 114 or DC (direct current) side (FIG. 2D). The dual module system 100 is secured to an interface surface 116 (FIGS. 3A–3B).

As exemplified and shown in FIGS. 2B–2C, the primary surfaces 112 of the first and second modules 102 and 104 respectively comprise beamformer circuits or beamformers 118 and 120, preferably MMIC (monolithic microwave integrated circuit) amplitude and phase weighting circuits. The first module 104 may be polarized with right hand circular polarization and, accordingly, the beamformer 118 can be referred to as a right-hand circular polarization beamformer (RHCP). Similarly, the beamformer 120 for the second module 104 may be polarized with left-hand circular polarization and, accordingly, the beamformer 120 can be referred to as a left-hand circular polarization beamformer (LHCP).

Each beamformer 118, 120 comprises a plurality of phase shift elements 122. In this embodiment, each beamformer 118, 120 comprises twenty-four channels of MMIC amplitude and phase weighting circuits 122 or phase shift elements. In general, phased array antenna systems generate signals of opposite polarization (RHCP and LHCP) to maximize data transmitted or received in a given amount of assigned frequency spectrum. This approach allows two sets of user beams to share the same frequency spectrum without interference. It is thus necessary to assign user beams to each polarization and provide these composite RF signals to each radiating element of the array. Typically, a radiating element is designed with separate input ports for each polarization. As shown in FIGS. 2B and 2C, twelve of the phase shift elements 122 are connected to a first circuitry 124 and another twelve of them are connected to a second circuitry 126. The first circuitry 124 drives a first amplifier 128 of the first radiating element 106 while the second circuitry 126 drives a second amplifier 129 of the second radiating element 108. The amplifiers 128 and 129 are respectively connected to output lines 130 and 131 of the phase shifters 122 in the first and the second circuits 124 and 126. In both modules 102 and 104, the amplifiers 128 and 129 are connected to the radiating elements 106 and 108 via a first feeder line 132 and a second feeder 134, respectively.

In this embodiment, twelve beam input lines 136 are split into first and second input lines 138 and 140 to provide beam input for each radiating element 102 and 104. As shown in FIGS. 2B and 2C, the input lines 138 provide beam input for the phase shifters 122 in the first circuitry 124 and the input lines 140 provide beam input for the phase shifters 122 in the second circuit. In this embodiment, input lines 136 are connected to input ports 142 located at lower ends 144 of the modules 102 and 104, where the dual module system 100 is secured to the interface surface 116.

FIG. 2D shows the secondary or DC side 114 of one of the beamformer modules 102 or 104, for example the beamformer module 102. The secondary sides 114 of the modules comprise substantially identical features. Therefore, for the purpose of clarity, such features will be described using the secondary side 114 of the first module 102. The DC side 114 comprises a number of control circuitry 146, which may preferably be application specific integrated circuits (ASICs). ASICs 146 provide control signals to the phase shifter MMICs 122.

Figure 4:
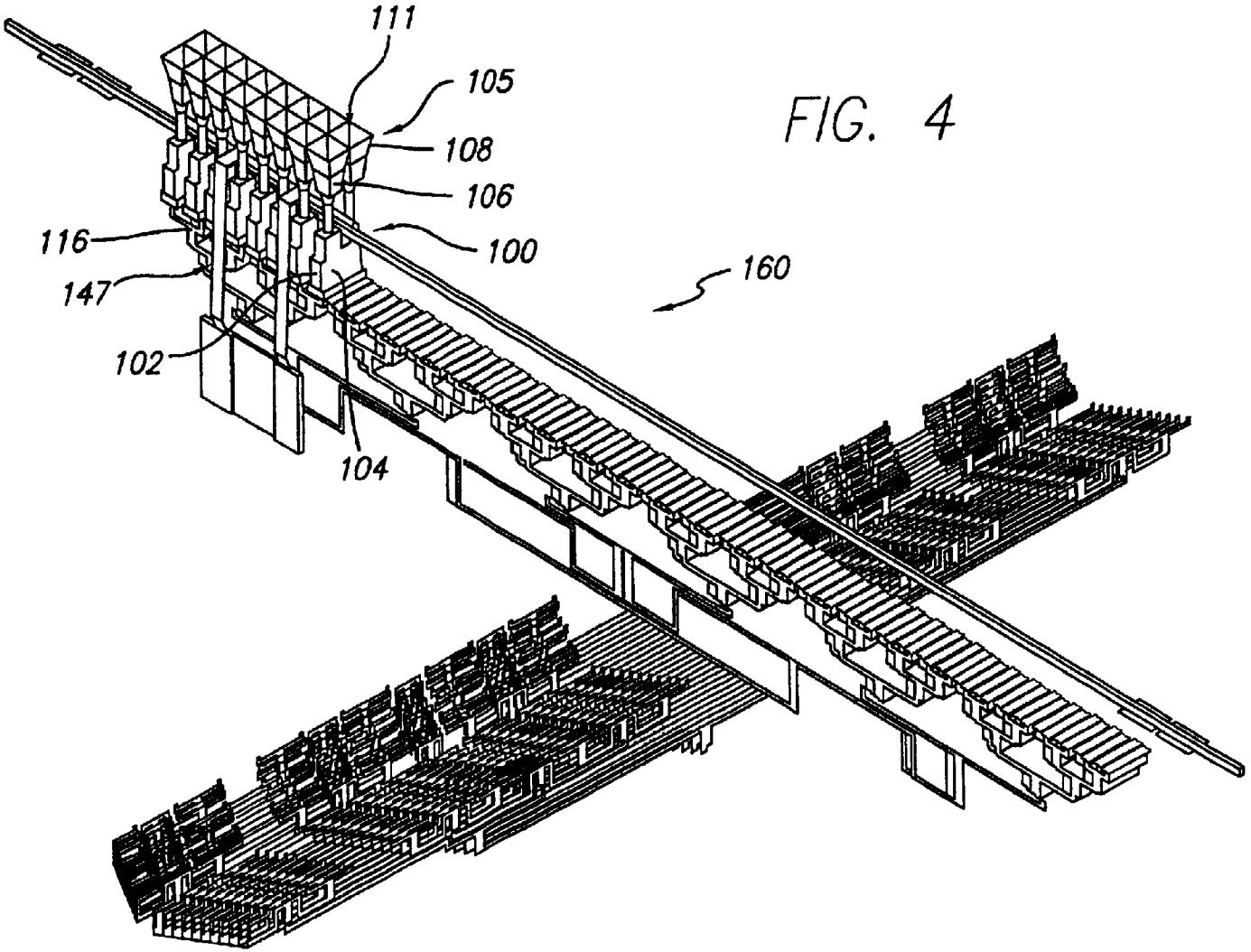
FIG. 4 is a partial perspective view of a phased array antenna of the present invention.

FIG. 3A shows the wave guide interface surface 116 where the beamformer module of the invention is connected to a waveguide power splitter 147 shown in FIG. 3B. Referring to FIG. 3A, the interface surface 116 is partitioned into a plurality of dual module sections 148 to connect a plurality of the dual module systems 100 of the present invention. For purposes of illustration, the interface surface 116 comprises eight dual module sections 148. The sections 148 are sized and shaped to match the top planar area 110 defined by the dual element 105 (FIGS. 2B and 4) which may be generally rectangular in shape. Each section 148 allows one way input signal to the corresponding dual module systems. Therefore, in this embodiment, each wave guide power splitter 147 comprises eight ways. In one embodiment, the sections 148 are sized to have 2"×4" dimensions. Advantageously, both beamformer modules 102 and 104 share the same space designated for two radiating elements. The dual module system thereby doubles the number of beams to be fed to radiating elements in a given phased array antenna system.

Each dual module section 148 comprises a number of waveguide openings 150 configured as two parallel rows, namely a first opening row 152 and a second opening row 154. The wave guide openings 150 form the input channels of the wave guide power splitter 147. In this embodiment, each opening row 152, 154 comprises twelve waveguide openings 150 to receive twelve input ports 142 of the beamformer modules 102 and 104. With this configuration, the wave guide power splitter 147 may be referred to as a twenty-four channel, eight-way power splitter which can drive sixteen of the radiating elements 106, 108 or eight of the dual elements 105.

In mounting the dual module system 100 with the dual element 105, the input ports 142 of the first beamformer module 102 may be coupled with the openings 150 in the first row 152 while the input ports 142 of the second beam former module 104 may be coupled with the openings 150 in the second row 154. When mounted on the interface 116, the first and second beamformer modules 102, 104 may be substantially parallel to one another and both may be substantially perpendicular to the interface surface 116. Accordingly, a plurality of dual element systems 100 can be mounted in similar fashion to form a phased array antenna. Once connected to the wave guide power splitter 147, a beam signal can be inputted into the dual module system 100 through the wave guide power splitter 147.

In FIG. 5, a partially assembled phased array antenna shows eight of the dual radiating elements 105 assembled on top of eight of the dual module systems 100 which are, in turn, mounted on the wave guide power splitter 147 of the phased array antenna 160.

It should be understood, of course, that the foregoing relates to preferred embodiments of the invention and that modifications may be made without departing from the spirit and scope of the invention as set forth in the following claims.

We claim:

1. A modular beamformer system for providing signals to at least two radiating elements of a phased array antenna comprising:

a first beamformer module coupled to the at least two radiating elements, wherein the first beamformer module comprises:

at least two first groups of beamforming circuitry on a primary plane of the first beamformer module; and at least one first feeder line extending from the at least two first groups of beamforming circuitry, the at least one first feeder line coupled to one of the radiating elements to transmit an output from the at least two first groups of beamforming circuitry;

a second beamformer module coupled to the at least two radiating elements, wherein the second beamformer module comprises:

at least two second groups of beamforming circuitry on a primary plane of the second beamformer module; and at least one second feeder line extending from the at least two second groups of beamforming circuitry, the at least one second feeder line coupled to one of the radiating elements to transmit an output from the at least two second groups of beamforming circuitry.

2. The modular beamformer system of claim 1, wherein the first and second beamformer modules form a dual beamformer module to drive the at least two radiating elements.

3. The modular beamformer system of claim 2, wherein the dual beamformer module is coupled to an interface of a waveguide power splitter of the phased array antenna.

4. The modular beamformer system of claim 3, wherein at least one of the first and second groups of beamforming circuitry comprises phase shift elements.

5. The modular beamformer system of claim 4, wherein the phase shift elements comprise MMIC amplitude and phase weighting circuits.

6. The modular beamformer system of claim 5, wherein the at least two first groups of beamforming circuitry of the first beamformer module comprise right-hand circular polarization.

7. The modular beamformer system of claim 6, wherein the at least two second groups of beamforming circuitry of the second beamformer module comprise left-hand circular polarization.

8. The modular beamformer system of claim 7, wherein the at least two first groups of beamforming circuitry comprises a first circuitry and a second circuitry.

9. The modular beamformer system of claim 8, wherein the first circuitry comprises a first predetermined number of phase shift elements.

10. The modular beamformer system of claim 9, wherein the second circuitry comprises a second predetermined number of phase shift elements.

11. The modular beamformer system of claim 10, wherein the first and the second predetermined numbers each equal twelve.

12. The modular beamformer system of claim 11, wherein the first beamforming circuitry comprises twelve first input lines connected a group of twelve input ports of the wave guide power splitter.

13. The modular beamformer system of claim 12, wherein the second beamformming circuitry comprises twelve second input lines connected the group of twelve input ports of the wave guide power splitter.

14. The modular beamformer system of claim 13, wherein the twelve first input lines are connected to twelve first phase shift elements in the first beamforming circuitry on a one phase shift element per input line basis.

15. The modular beamformer system of claim 14, wherein the twelve second input lines are connected to twelve second phase shift elements in the second beam forming circuitry on a one phase shift element per input line basis.

16. The modular beamformer system of claim 1, wherein the first beamformer module comprises at least two first amplifiers coupled to the at least one first feeder line.

17. The modular beamformer system of claim 1, wherein the second beamformer module comprises at least two second amplifiers coupled to the at least second feeder line.

* * * * *